United States Patent [19]

Frosch et al.

[11] 4,118,014

[45] Oct. 3, 1978

[54] VEHICULAR IMPACT ABSORPTION SYSTEM

[76] Inventors: Robert A. Frosch, Administrator of the National Aeronautics and Space Administration, with respect to an invention of; Albert C. Knoell, La Crescenta; Abraham H. Wilson, Sherman Oaks, both of Calif.

[21] Appl. No.: 826,204

[22] Filed: Aug. 19, 1977

[51] Int. Cl.[2] ..... E01F 15/00

[52] U.S. Cl. ..... 256/1; 188/1 C; 256/13.1

[58] Field of Search ..... 256/13.1, 1; 188/1 C

[56] References Cited

U.S. PATENT DOCUMENTS

| | | | |
|---|---|---|---|
| 2,998,214 | 8/1961 | Peterman | 188/1 C X |
| 3,666,055 | 5/1972 | Walker | 256/13.1 X |
| 3,845,936 | 11/1974 | Boedecker, Jr. | 256/13.1 X |
| 3,880 404 | 4/1975 | Fitch | 256/13.1 X |
| 3,944,187 | 3/1976 | Walker | 256/13.1 |
| 3,951,384 | 4/1976 | Hildreth | 256/1 |
| 4,008,915 | 2/1977 | Walker | 188/1 C X |

*Primary Examiner*—Andrew V. Kundrat
*Attorney, Agent, or Firm*—Monte F. Mott; John R. Manning; Wilfred Grifka

[57] ABSTRACT

An improved vehicular impact absorption system characterized by a plurality of aligned crash cushions of substantially cubic configuration, each consisting of a plurality of voided aluminum beverage cans arranged in substantial parallelism within a plurality of superimposed tiers and a covering envelope formed of metal hardware cloth, and a plurality of cables extended through the cushions in substantial parallelism with an axis of alignment for the cushions adapted to be anchored at each of the opposite ends thereof.

5 Claims, 3 Drawing Figures

VEHICULAR IMPACT ABSORPTION SYSTEM

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435, 42 USC 2457).

BACKGROUND OF THE INVENTION

1. Field of the Invention:

The invention generally relates to impact absorption systems and more particularly to an improved vehicular impact absorption system for arresting impacting vehicles at the lowest possible deceleration level, whereby smoother and safer occupant deceleration for an enlarged class of vehicular impact weights is facilitated.

2. Description of the Prior Art:

Cushion-type crash barrier systems have been employed along the nation's highways since the 1960's. Such systems are intended to provide impact protection for obstacles such as roadway gores, tunnel entrances, as well as bridge and freeway abutments.

The systems of the prior art are typified by the devices and systems generally disclosed in the U.S. Pat. Nos:

| | | | |
|---|---|---|---|
| Hudson | 2,088,087 | July | 27, 1937 |
| Blackman | 2,413,210 | Dec. | 24, 1946 |
| Sipkin | 2,562,957 | Aug. | 7, 1951 |
| Fitch | 3,606,258 | Sept. | 20, 1971 |
| Fitch | 3,643,924 | Feb. | 22, 1972 |
| Boedecker et al. | 3,845,936 | Nov. | 5, 1974 |
| Fitch | 3,856,268 | Dec. | 24, 1974 |
| Welch | 3,876,185 | April | 8, 1975 |
| Fitch | 3,880,404 | April | 29, 1975 |
| Hildreth | 3,951,384 | April | 20, 1976 |

Heretofore, the Federal Highway Administration has approved at least five specific crash barrier systems for highway application. Among these systems are the so-called steel drum and High-Dry Cell sandwich systems which dissipate energy, primarily through a sacrificial crushing of the structure thereof. The other approved systems generally fall within a class of crash cushions which dissipate energy largely by momentum transfer.

Also, certain of the systems heretofore suggested include a capability for altering vehicle direction, upon impact, while other systems, such as the steel drum impact absorption system, tend to "capture" a vehicle, and still others, such as the High-Dry Cell clusters, are designed to perform both functions.

As can be appreciated with those familiar with the design of those barriers having a capability for returning a vehicle back into the flow of traffic such do not require a use structure capable of achieving total dissipation of energy. However, these systems present a potentially dangerous problem of how to avoid an initiation of further crashes as the vehicle is redirected.

Among the advantages realized through the use of systems capable of capturing a vehicle, on impact, is that of avoiding further crashes. However, such systems must be capable of providing for smooth deceleration at relative low G-loads. The conventional steel drum impact absorption system, aforementioned, is, in many instances, capable of achieving a desired relatively smooth and generally safe occupant deceleration on impact. However, among the disadvantages encountered when using such systems are high installation costs, utilization of excessive space, and a generally displeasing appearance.

It should therefore be apparent that there currently exists a need for a durable, economic and practical impact absorption system having an energy dissipating capacity such that significant quantities of energy absorption can be realized at relatively low crushing forces and yet posses an appearance capable of generating confidence in its use while avoiding driver distraction.

It is therefore the general purpose of the instant invention to provide an improved, economical and practical vehicular impact absorption system having an improved appearance and a capability of providing for smoother and safer occupant deceleration for a larger class of vehicle impact weight.

OBJECTS AND SUMMARY OF THE INVENTION

It is therefore an object of the instant invention to provide an improved vehicular impact absorption system which overcomes the aforementioned difficulties and disadvantages.

It is another object to provide an improved, economical and practical impact absorption system particularly suited for use in protecting structures situated along the highway.

It is another object to provide in an impact absorption system a plurality of aligned crash cushions having a capability of protecting highway abutments from impacting vehicles.

It is another object to provide in a vehicular impact absorption system adapted to capture an impacting vehicle.

It is another object to provide an improved vehicular impact absorption system which is reliable in operation, economic to fabricate, install and maintain, and yet maintain a capability of functioning satisfactorily under extreme climatic conditions while retaining an appearance which enhances confidence in use and reduces driver distraction.

Another object is to provide a vehicular impact absorption system particularly suited for use in protecting highway abutments from impacting vehicles and the like although not necessarily restricted in use thereto since the system may be successfully employed for absorbing impact in other environments in which a use of a sacrificial energy-absorbing barrier is required in arresting motion of a moving mass.

These and other objects and advantages are achieved through the use of an impact absorption system characterized by a plurality of aligned crash cushions, each cushion of the plurality being of a substantially cubic configuration and consisting of a plurality of voided aluminum beverage cans arranged in substantial parallelism within a plurality of superimposed tiers and an envelope for encasing the cushion, and a plurality of cables extended through the cushion in parallelism with the axes of the cans for securing the cushions in the systems as will become more readily apparent with references to the following description and claims in light of the accompanying drawings.

DESCRIPTION OF THE PREFERRED EMBODIMENT

Figure 1:
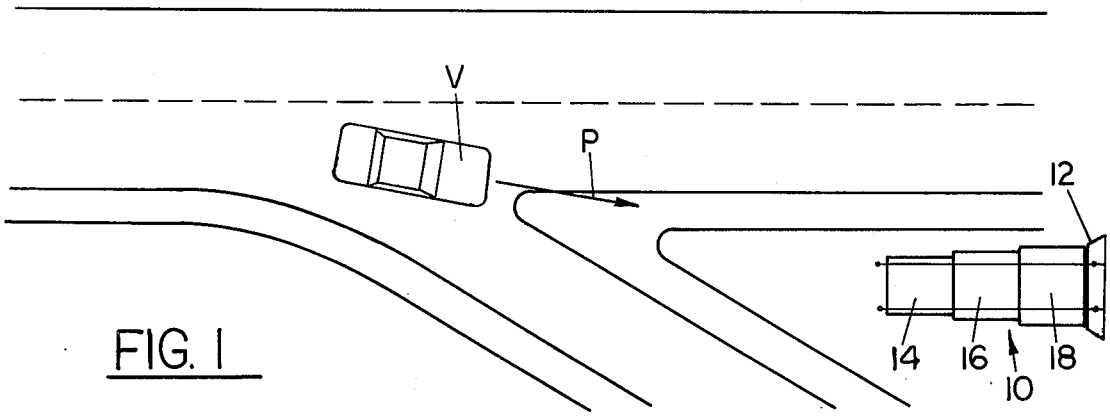
FIG. 1 is a top plan view pictorially illustrating an environment in which is employed a vehicular impact absorption system which embodies the principles of the instant invention.

Referring now to the drawings wherein like reference characters designate like or corresponding parts throughout the several views, there is shown in FIG. 1 a modular vehicular impact absorption system, generally designated 10, which embodies the principles of the instant invention. As shown, system 10 is disposed alongside a highway in protective relation with an obstruction 12, which for illustrative purposes only, is here described as an approach to a bridge abutment, not shown. However, it is to be understood, that the system 10, is, where desired, employed in protecting obstructions such as roadway gores, tunnel entrances and the like without departing from the spirit of the instant invention. Moreover, while not illustrated, it is to be understood that the system 10 preferably is in practice deployed in a manner such that the protected structure 12 serves to support the system against impact-induced displacement.

Figure 2:
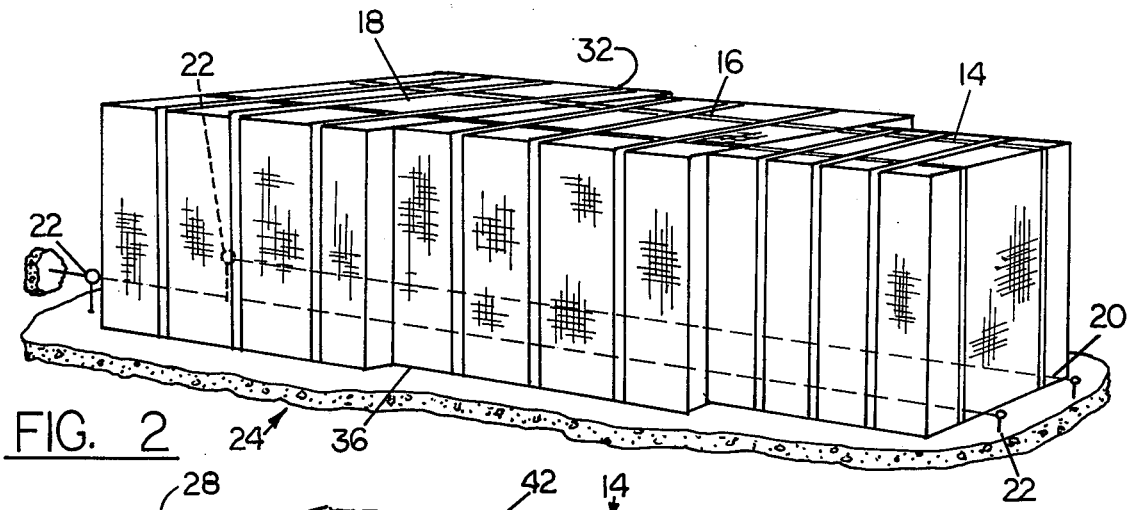
FIG. 2 is a fragmented perspective view of the impact absorption system shown in FIG. 1, on an enlarged scale, and rotated through approximately 180° for the sake of clarity.

The system 10, as best illustrated in FIG. 2, includes a plurality of similarly configured contiguously related crash cushions, designated 14, 16 and 18. The crash cushions 14 through 18 are disposed in axial alignment and secured together by a pair of cables 20 extended in parallelism with the axis of alignment for the cushions connected with anchor posts 22 extended downwardly into the cement base, generally designated 24, which serves as supporting structure for the system 10. It is noted that the cables 20 are located at a suitable elevation, relative to the base 24, so that an automobile or similar vehicle will pass over and not impact against the cables prior to impacting against the cushions. However, it is to be understood that the cables 20 also are suitably positioned for retaining the cushion in substantial alignment even during impact.

It is to be understood, further, that each of the crash cushions is of a similar design, even though not necessarily of similar dimensions, as illustrated. Therefore a detailed description of a single crash cushion, or module, is deemed adequate to provide for complete understanding of the instant invention.

Figure 3:
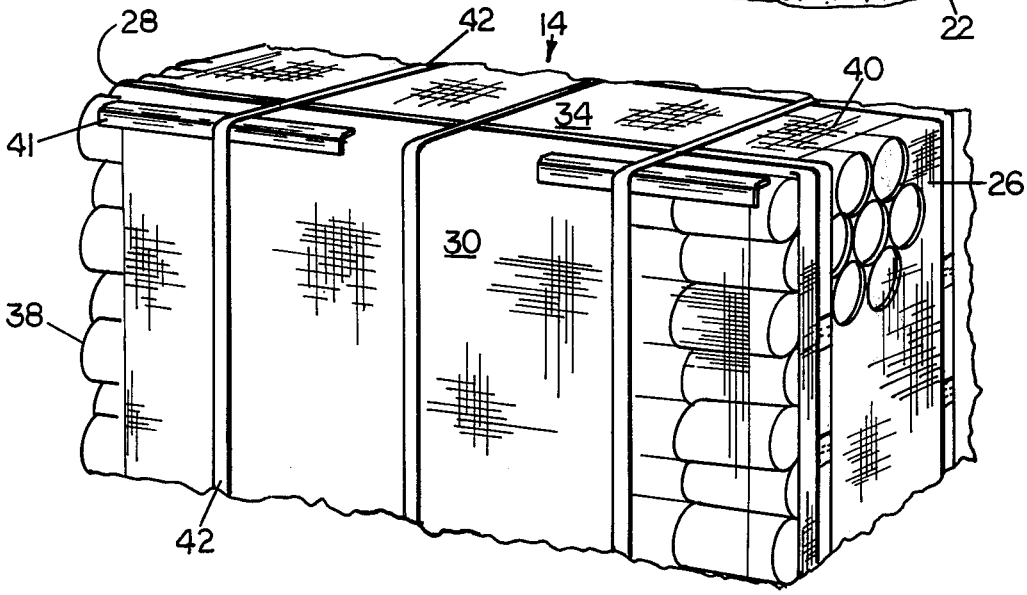
FIG. 3 is an enlarged fragmented perspective view of one of the modules shown in FIG. 2.

As shown in FIG. 3, the crash cushion 14 is of a generally cubic configuration having six sides, four of which are disposed in substantial vertical planes while the other two are disposed in horizontal planes. Hence, the cushion includes a pair of opposite end surfaces, designated 26 and 28, disposed in vertical planes, a pair of opposite side surfaces, designated 30 and 32, also disposed in vertical planes, and horizontally disposed top and bottom surfaces designated 34 and 36, respectively.

As illustrated in FIG. 2 the cushion 14 rests on its bottom surface 36. The cushions 14 through 18 are, when so desired, suitably supported by rails, blocks and similar structures which serve to accommodate horizontal displacement thereof during impact.

Each of the crash cushions 14 through 18 is fabricated employing a plurality of aluminum beverage cans, designated 38, from which the contents have been discharged to establish a voided or empty condition therefor. In order to facilitate a discharge of the contents from the beverage cans, each is provided with an opening, not designated, whereby the internal and external pressures to which the can is subjected are equalized.

The cans 38 are arranged in horizontal tiers with the internally disposed cans being nested in a six-point contact with six adjacent cans. Thus maximum lateral stability for the cans is provided during impact.

Disposed in an encasing relation with the tiers of cans, there is a metal hardware cloth 40 which serves to define an envelope for the module forming the cushion. At the corner edges, where so desired, there is disposed flexible supports 41 provided for supporting tie straps 42. The straps 42 encircle the cushion for securing the envelope 40 in place. As a practical matter, as many straps as is found desirable are employed for this purpose.

During the assembly of the system 10, the cables 20 are threaded through the cushions 14 through 18 and thereafter "tied" to the anchor posts 22, preferably embedded in the base 24. Of course, the cables also may be secured to anchor pins, as shown, FIG. 2, projected horizontally from the structure to be protected by the system 10.

OPERATION

The operation of the described embodiment of the present invention is believed to be clearly apparent, however, for the sake of clarity it briefly is summarized at this point.

With the system 10 assembled in the manner hereinbefore described, and disposed in protective relation with an obstruction, as an abutment, the system is prepared for operation.

Assuming that a vehicle, designated V, FIG. 1, approaches the obstruction along a path, designated P, also as illustrated in FIG. 1, the vehicle ultimately will impact against the end surface 26 of the crash cushion 14 of the system. Of course, as the vehicle impacts against the surface of the crash cushion 14, the individual cans 38 begin to collapse under a compressive force. Thus energy is dissipated at a controlled rate determined in part by the number of cans employed for each cushion and the number of cushions enveloped in the system. To exemplify, it has been found that when using a seven layer, or tier, forty-nine 12 oz. aluminum can per layer configuration for a module forming a cushion, and an average crushing force application of 4000-pounds, the energy dissipated by the longitudinal crushing of the module was approximately 8400-fast pounds. Moreover, it has been demonstrated that for given configurations, vehicles weighing up to 4850-pounds can be arrested satisfactorily.

Finally, it can be shown analytically that for both a 2000-pound and a 4000-pound vehicle system which embodies the principles of the instant invention results in lower average occupant deceleration levels than when employing a steel drum cushion. Of course, the substantially lower deceleration levels experienced during initial portions of the crushing of the cushion indicate smoother deceleration during vehicle impact.

As should be apparent, as the cans crush, the cushions collapse at a decreasing rate as the energy is dissipated. Due to the fact that each of the cans collapse independently of all other cans, the vehicle embeds itself in the barrier and thus is captured as its motion is arrested.

Hence, it is believed to be apparent that the system which embodies the principles of the instant invention provides for smoother and safer occupant deceleration for a larger class of vehicle impact weights than heretofore provided when employing sacrificial barriers.

What is claimed is:

1. In an impact absorption system particularly suited for use in shielding a structure such as a highway abutment from impacting engagement with a moving mass, such as an automobile, the improvement comprising:

A. a modular crash cushion comprising one of a plurality of contiguous cushions adapted to be positioned within the path of a moving mass including a contiguous plurality of collapsible bodies of cylindrical configuration comprising voided beverage cans formed of an alloy consisting essentially of aluminum arranged in multiple tiers with the longitudinal axes thereof extended in substantial parallelism with the path of the moving mass, each of the bodies disposed internally of the cushion being nested in six-point contact with adjacent bodies, whereby maximum lateral stability is provided therefor;

B. a metal hardware cloth mesh enclosure defining an envelope for said cushion, and means for securing the enclosure in place relative to said plurality of bodies including a plurality of transversely related straps; and C. means for securing the crash cushion against substantial transverse displacement relative to said path.

2. An impact absorption system particularly suited for use in protecting highway abutments and the like from impacting vehicles adapted to capture the vehicles during the deceleration thereof comprising:

A. a plurality of contiguously related crash cushions disposed in axial alignment, each cushion of said plurality being of a substantially cubic configuration and consisting of a plurality of voided metallic beverage cans arranged in substantial parallelism in a plurality of superimposed tiers, each internally disposed can of the cushion being nested in contact with six adjacent cans for providing therefor maximum lateral stability and an envelope formed of metal hardware cloth secured in place about the beverage cans; and B. means for securing said crash cushions in axial alignment including a plurality of cables extended through the plurality of cushions in parallelism with the axis of alignment therefor, each cable of said plurality being adapted to be anchored at each of its opposite ends within a supporting structure provided for supporting the system.

3. The system of claim 2 wherein the beverage cans are uniformly distributed throughout each of the cushions with the axes thereof disposed in substantial parallelism with the axis of alignment for the plurality of cushions.

4. The system of claim 3 wherein the cables are elevated above the supporting structure a distance sufficient to accommodate passage of a vehicle thereover.

5. The system of claim 3 wherein the beverage cans are formed of an alloy consisting essentially of aluminum.

* * * * *